US006260811B1

(12) United States Patent
O'Neil

(10) Patent No.: US 6,260,811 B1
(45) Date of Patent: Jul. 17, 2001

(54) CUP HOLDER ATTACHMENT

(76) Inventor: William Scott O'Neil, 167 Southville Rd., Southborough, MA (US) 01772

( * ) Notice: Subject to any disclaimer, the term of this patent is extended or adjusted under 35 U.S.C. 154(b) by 0 days.

(21) Appl. No.: 09/428,856

(22) Filed: Oct. 28, 1999

(51) Int. Cl.[7] ..... A47K 1/08

(52) U.S. Cl. ..... 248/311.2; 248/231.81; 248/299.1; 248/307; 248/315; 297/188.05; 297/188.06

(58) Field of Search ..... 297/188.04, 188.05, 297/188.06, 188.2, 188.21, 188.14, 188.18; 248/311.2, 315, 299.1, 307, 231.81, 215, 340, 304

(56) References Cited

U.S. PATENT DOCUMENTS

| | | | | |
|---|---|---|---|---|
| D. 226,623 | | 4/1973 | Shuford . | |
| 3,233,940 | | 2/1966 | Tooley, Jr. . | |
| 3,675,969 | | 7/1972 | Gage . | |
| 4,795,211 | | 1/1989 | Stern et al. . | |
| 5,238,212 | | 8/1993 | Dechellis . | |
| 5,395,085 | | 3/1995 | Mann . | |
| B1 3,477,679 | * | 11/1969 | Lovitz | 248/311.2 |
| B1 3,602,960 | * | 9/1971 | Urbigkeit | 248/299.1 |
| B1 4,557,452 | * | 12/1985 | Khuong | 248/311.2 |
| B1 4,825,590 | * | 5/1989 | Cullinane | 248/311.2 X |
| B1 5,421,638 | * | 6/1995 | Ayotte et al. | 297/188.04 |

* cited by examiner

*Primary Examiner*—Ramon O. Ramirez
*Assistant Examiner*—Korie H. Chan

(57) ABSTRACT

A cup holder attachment for holding a beverage container and mounting to the backrests of a pair of adjacent seats in a row of seats. The cup holder attachment includes a base with an upper ring spaced above the base and an elongate support extending between the base and the upper ring to connect them together. Fixed and sliding clips are provided each designed for hooking over a backrest of a seat. The fixed clip is coupled to the upper ring and the sliding clip is slidably mounted to the upper ring to permit slidable positioning of the sliding clip along the upper ring with respect to the location of the fixed clip.

7 Claims, 2 Drawing Sheets

CUP HOLDER ATTACHMENT

BACKGROUND OF THE INVENTION

1. Field of the Invention

The present invention relates to cup holders and more particularly pertains to a new cup holder attachment for holding a beverage container and mounting to the backrests of a pair of adjacent seats in a row of seats.

2. Description of the Prior Art

The use of cup holders is known in the prior art. More specifically, cup holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,395,085; U.S. Pat. No. Des. 226,623; U.S. Pat. No. 5,238,212; U.S. Pat. No. 4,795,211; U.S. Pat. No. 3,675,969; and U.S. Pat. No. 3,233,940.

While these devices fulfill their respective, particular objectives and requirements, the aforementioned patents do not disclose a new cup holder attachment. The inventive device includes a base with an upper ring spaced above the base and an elongate support extending between the base and the upper ring to connect them together. Fixed and sliding clips are provided each designed for hooking over a backrest of a seat. The fixed clip is coupled to the upper ring and the sliding clip is slidably mounted to the upper ring to permit slidable positioning of the sliding clip along the upper ring with respect to the location of the fixed clip.

In these respects, the cup holder attachment according to the present invention substantially departs from the conventional concepts and designs of the prior art, and in so doing provides an apparatus primarily developed for the purpose of holding a beverage container and mounting to the backrests of a pair of adjacent seats in a row of seats.

SUMMARY OF THE INVENTION

In view of the foregoing disadvantages inherent in the known types of cup holders now present in the prior art, the present invention provides a new cup holder attachment construction wherein the same can be utilized for holding a beverage container and mounting to the backrests of a pair of adjacent seats in a row of seats.

The general purpose of the present invention, which will be described subsequently in greater detail, is to provide a new cup holder attachment apparatus and method which has many of the advantages of the cup holders mentioned heretofore and many novel features that result in a new cup holder attachment which is not anticipated, rendered obvious, suggested, or even implied by any of the prior art cup holders, either alone or in any combination thereof.

To attain this, the present invention generally comprises a base with an upper ring spaced above the base and an elongate support extending between the base and the upper ring to connect them together. Fixed and sliding clips are provided each designed for hooking over a backrest of a seat. The fixed clip is coupled to the upper ring and the sliding clip is slidably mounted to the upper ring to permit slidable positioning of the sliding clip along the upper ring with respect to the location of the fixed clip.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cup holder attachment apparatus and method which has many of the advantages of the cup holders mentioned heretofore and many novel features that result in a new cup holder attachment which is not anticipated, rendered obvious, suggested, or even implied by any of the prior art cup holders, either alone or in any combination thereof.

It is another object of the present invention to provide a new cup holder attachment which may be easily and efficiently manufactured and marketed.

It is a further object of the present invention to provide a new cup holder attachment which is of a durable and reliable construction.

An even further object of the present invention is to provide a new cup holder attachment which is susceptible of a low cost of manufacture with regard to both materials and labor, and which accordingly is then susceptible of low prices of sale to the consuming public, thereby making such cup holder attachment economically available to the buying public.

Still yet another object of the present invention is to provide a new cup holder attachment which provides in the apparatuses and methods of the prior art some of the advantages thereof, while simultaneously overcoming some of the disadvantages normally associated therewith.

Still another object of the present invention is to provide a new cup holder attachment for holding a beverage container and mounting to the backrests of a pair of adjacent seats in a row of seats.

Yet another object of the present invention is to provide a new cup holder attachment which includes a base with an upper ring spaced above the base and an elongate support extending between the base and the upper ring to connect them together. Fixed and sliding clips are provided each designed for hooking over a backrest of a seat. The fixed clip is coupled to the upper ring and the sliding clip is slidably mounted to the upper ring to permit slidable positioning of the sliding clip along the upper ring with respect to the location of the fixed clip.

Still yet another object of the present invention is to provide a new cup holder attachment that is mountable to the backrests of variously spaced apart seats at theaters, arenas and stadiums to hold the user's beverage container.

Even still another object of the present invention is to provide a new cup holder attachment that may be easily carried by a user to theaters, arenas and stadiums.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
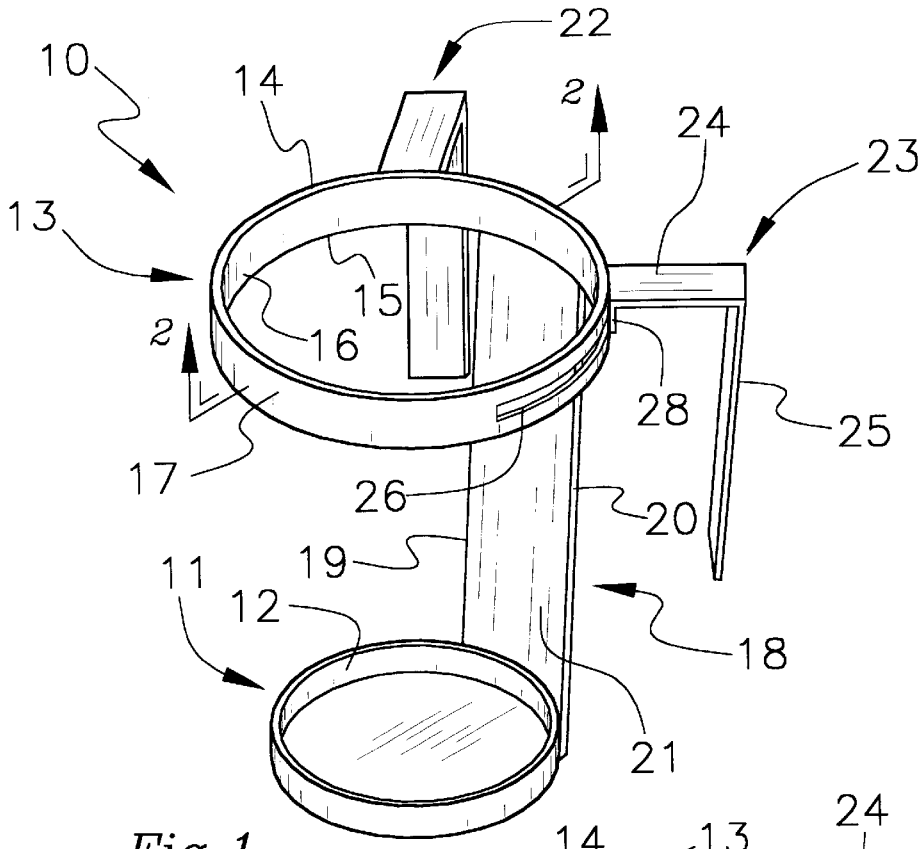
FIG. 1 is a schematic perspective view of a new cup holder attachment according to the present invention.

With reference now to the drawings, and in particular to FIGS. 1 through 4 thereof, a new cup holder attachment embodying the principles and concepts of the present invention and generally designated by the reference numeral 10 will be described.

As best illustrated in FIGS. 1 through 4, the cup holder attachment 10 generally comprises a base with an upper ring spaced above the base and an elongate support extending between the base and the upper ring to connect them together. Fixed and sliding clips are provided each designed for hooking over a backrest of a seat. The fixed clip is coupled to the upper ring and the sliding clip is slidably mounted to the upper ring to permit slidable positioning of the sliding clip along the upper ring with respect to the location of the fixed clip.

In closer detail, the beverage container holder 10 comprises a preferably disk-shaped base 11 having a center, generally circular and substantially planar top and bottom faces, and a generally circular outer perimeter. In a preferred embodiment, the base has an annular lip 12 upwardly extending from the top face of the base around the outer perimeter of the base.

A preferably generally circular upper ring 13 is spaced above the top face of the base. The upper ring has a center, generally circular upper and lower edges 14, 15, and generally cylindrical inner and outer sides 16, 17. Preferably, the centers of the base and the upper ring are generally coaxial with one another. The upper and lower edges of the upper ring preferably lie in substantially parallel planes with one another generally parallel to the top face of the base.

An elongate support 18 is extended between the base and the upper ring. The support has top and bottom ends. The top end of the support is coupled to the outer side of the upper ring and the bottom end of the support is coupled to the outer perimeter of the base. The support has a pair of side edges 19, 20 extending between the top and bottom ends of the support and preferably substantially parallel to one another. In a preferred embodiment, the support may have a generally arcuate transverse cross section taken in a plane substantially perpendicular to the side edges of the support. In this preferred embodiment, the transverse cross section of the support has a concavity 21 facing in a direction towards a common axis defined between the centers of the base and upper ring.

The base has an outer diameter defined across the outer perimeter of the base. The upper ring has an inner diameter defined across the inner side of the upper ring and an outer diameter defined across the outer side of the upper ring. The inner diameter of the upper ring is preferably greater than the outer diameter of the base and the outer diameter of the upper ring is greater than the inner diameter of the upper ring. In an even more preferred embodiment, the support is extended from the top face of the base at an angle between about 45 degrees and about 90 degrees.

In an ideal illustrative embodiment, the outer diameter of the base is about 3 inches, the outer diameter of the upper ring is between about 3 inches to about 4 inches and the support has a length defined between the top and bottom ends of the support of about 6 inches.

In use, the upper ring is designed for inserting a beverage container therethrough such that a bottom of the beverage container is rested on the top face of the base.

Generally inverted-L-shaped fixed and sliding clips 22, 23 are provided each having an elongate upper portion 24 and an elongate lower portion 25 downwardly extending from the upper portion of the respective clip. Ideally, the lower portion of each clip is extended at an angle between about 70 degrees and about 90 degrees from the upper portion of the respective clip.

The upper portion of each clip has at an end opposite the lower portion of the respective clip. The end of the upper portion of the fixed clip is fixedly coupled to the outer side of the upper ring. The end of the upper portion of the sliding clip is slidably mounted to the upper ring to permit slidable positioning of the sliding clip along an arc defined along the outer side of the upper ring. The top end of the support is interposed between the ends of the fixed and sliding clips.

Preferably, the upper portions of the clips are extended radially outwards from the outer side of the upper ring such that the lower portions of the clips are spaced apart from the upper ring. Even more preferably, the upper portions of the clips generally lie in a common plane with the upper edge of the upper ring.

Figure 2:
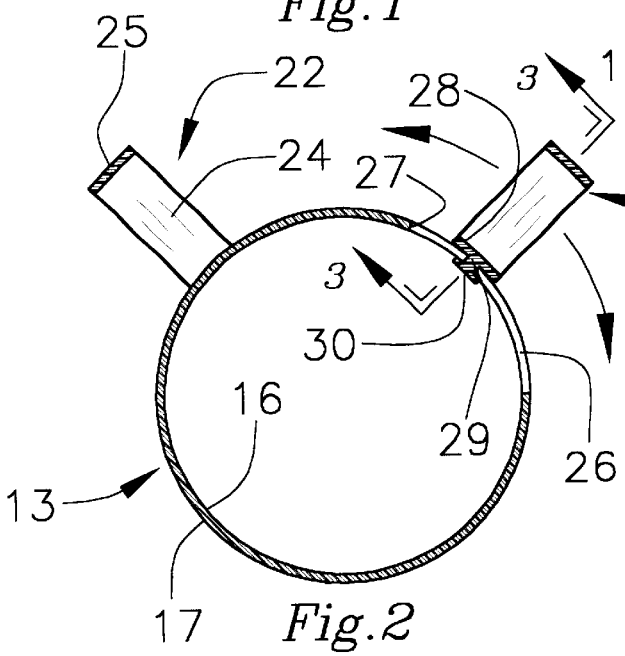
FIG. 2 is a schematic cross sectional view of the present invention looking upwards from line 2—2 of FIG. 1.
Figure 3:
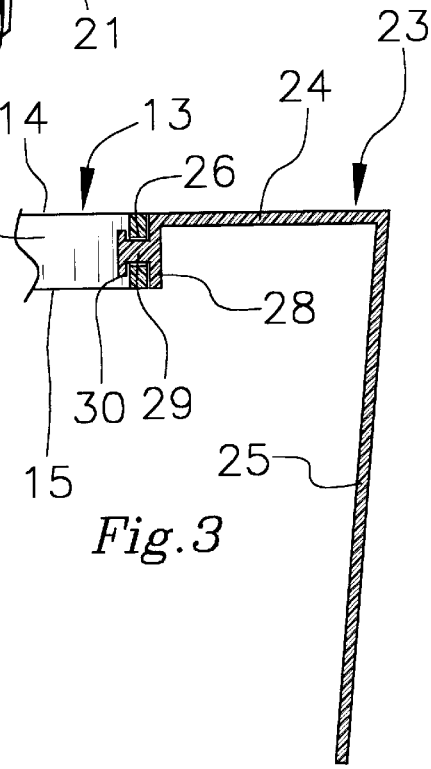
FIG. 3 schematic cross sectional view of the sliding clip and slot taken from line 3—3 of FIG. 2.

With particular reference to FIGS. 1, 2, and 3, the upper ring preferably has an elongate slot 26 therethrough between the inner and outer sides of the ring and extending in an arc along the upper ring. The arc of the slot preferably lies in a plane substantially parallel to the planes of the upper and lower edges of the upper ring. The slot has a terminus 27 positioned adjacent the top end of the support so that the top end of the support is interposed between the terminus and the end of the upper portion of the fixed clip.

As best illustrated in FIGS. 2 and 3, the end of the upper portion of the sliding clip has a downwardly extending tab 28 with an extent 29 outwardly extending therefrom and through the slot of the upper ring to permit sliding of the extent along the arc of the slot. The extent preferably terminates at a stop flange 30 located adjacent the inner side of the upper ring such that the slot of the upper ring is interposed between the stop flange and the tab.

With reference to FIG. 3, the stop flange and the slot each have a width defined in a generally vertical direction extending between the upper and lower edges of the upper ring. The width of the stop flange is greater than the width of the slot so that the extent may not be pulled out of the slot while still permitting sliding of the extent along the length of the slot.

In use, the sliding clip is slidable in the slot along the upper ring between inner and outer positions with the sliding clip spaced closer to the fixed clip when positioned in the inner position than when positioned in the outer position. The fixed clip and the sliding clip lie in generally vertical planes defining an angle therebetween. Preferably, the angle between the fixed and sliding clips is between about 45 degrees and about 180 degrees. The angle between the fixed and sliding clips is greater when the sliding clip is positioned in the outer position than when the sliding clip is positioned in the inner position. In an ideal embodiment, the angle between the fixed and sliding clips is about 60 degrees when the sliding clip is positioned in the inner position and about 135 degrees when the sliding clip is positioned in the outer position.

Figure 4:
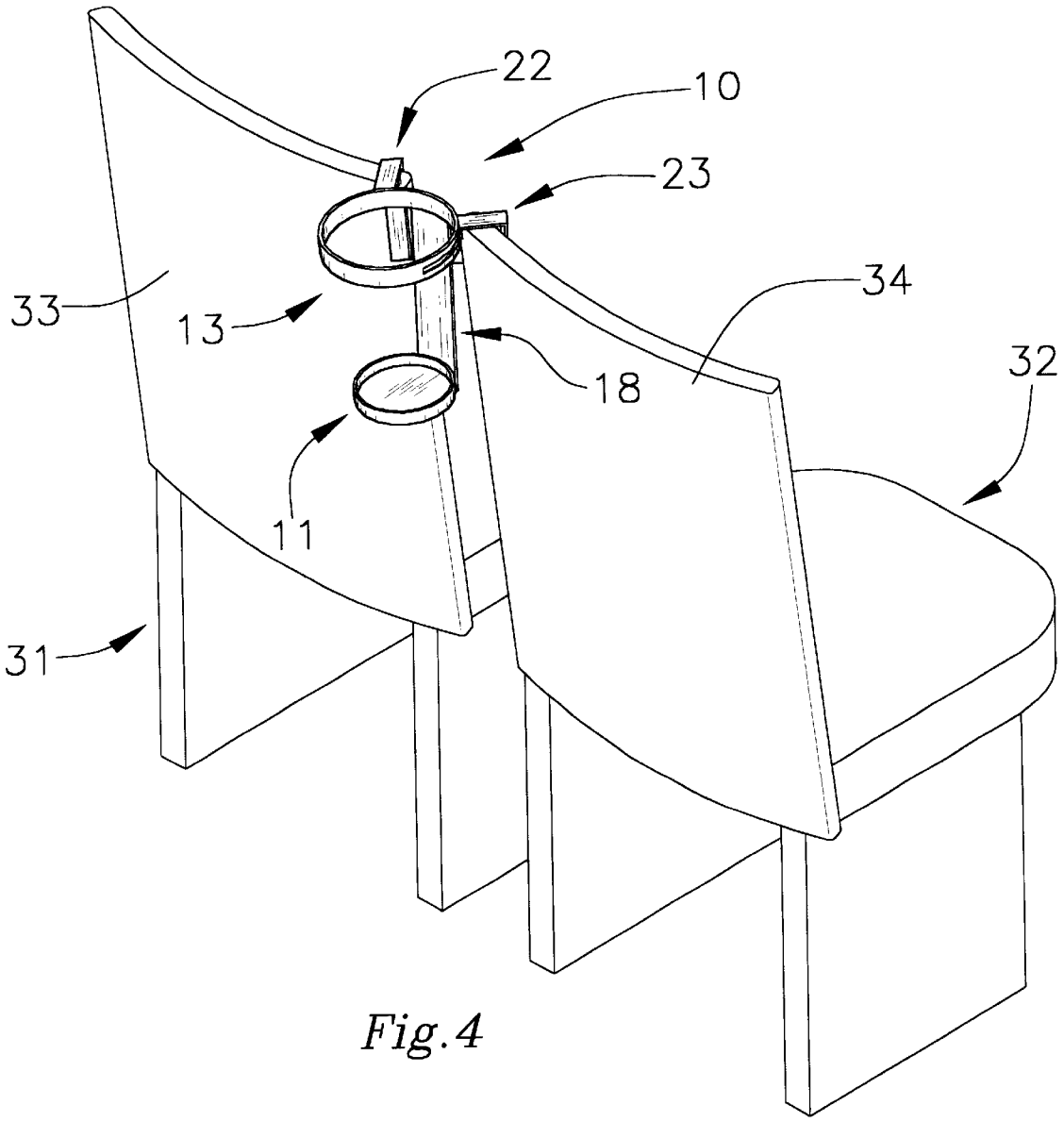
FIG. 4 is a schematic perspective view of the present invention in use mounted to the backrests of two adjacent seats.

In use the holder 10 is designed for mounting a beverage container between two spaced apart seats 31, 32 each having a backrest 33, 34 and which are arranged in a row such that the backrest generally lie a common vertical plane. As illustrated in FIG. 4, the fixed clip is hooked over the back rest of a first of the seats to mount the attachment to the first seat. The sliding clip is hooked over the backrest of a second of the seats positioned adjacent the first seat such that the upper ring and the base are positioned adjacent a space between the backrests of the adjacent first and second seats to mount the attachment and a supported beverage container to the backrests.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A beverage container holder, comprising:

a base;

an upper ring being spaced above said base;

an elongate support being extended between said base and said upper ring; and fixed and sliding clips each adapted for hooking over a backrest of a seat, said fixed clip being coupled to said upper ring, said sliding clip being slidably mounted to said upper ring to permit slidable positioning of said sliding clip along said upper ring with respect to the location of said fixed clip.

2. The beverage container holder of claim 1, wherein said base has an annular lip upwardly extending therearound.

3. The beverage container holder of claim 1, wherein said support is extended from said base at an angle between about 45 degrees and about 90 degrees.

4. The beverage container holder of claim 1, wherein said clips each have an elongate upper portion and an elongate lower portion downwardly extending from said upper portion of the respective clip, and wherein said lower portion of each clip is extended at an angle between about 70 degrees and about 90 degrees from said upper portion of the respective clip.

5. The beverage container holder of claim 1, wherein said upper ring has an elongate slot therethrough and extending in an arc along said upper ring, wherein said sliding clip has downwardly extending tab, wherein said tab has an extent outwardly extending therefrom through said slot of said upper ring to permit sliding of said extent along said arc of said slot.

6. The beverage container of claim 5, wherein said extent terminates at a stop flange such that said upper ring is interposed between said stop flange and said tab.

7. A beverage container holder system, comprising:

a disk-shaped base having a center, generally circular and substantially planar top and bottom faces, and a generally circular outer perimeter;

said base having an annular lip upwardly extending from said top face of said base around said outer perimeter of said base;

a generally circular upper ring being spaced above said top face of said base, said upper ring having a center, generally circular upper and lower edges, and generally cylindrical inner and outer sides;

said centers of said base and said upper ring being generally coaxial with one another;

said upper and lower edges of said upper ring lying in substantially parallel planes with one another generally parallel to said top face of said base;

an elongate support being extended between said base and said upper ring, said support having top and bottom ends, said top end of said support being coupled to said outer side of said upper ring, said bottom end of said support being coupled to said outer perimeter of said base;

said support having a pair of side edges extending between said top and bottom ends of said support and substantially parallel to one another;

said support having a generally arcuate transverse cross section taken in a plane substantially perpendicular to said side edges of said support;

said transverse cross section of said support having a concavity facing in a direction towards a common axis defined between said centers of said base and upper ring;

said base having an outer diameter defined across said outer perimeter of said base;

said upper ring having an inner diameter defined across said inner side of said upper ring and an outer diameter defined across said outer side of said upper ring;

said inner diameter of said upper ring being greater than said outer diameter of said base, said outer diameter of said upper ring being greater than said inner diameter of said upper ring;

said support being extended from said top face of said base at an angle between about 45 degrees and about 90 degrees;

generally inverted-L-shaped fixed and sliding clips each having an elongate upper portion and an elongate lower portion downwardly extending from said upper portion of the respective clip;

wherein said lower portion of each clip is extended at an angle between about 70 degrees and about 90 degrees from said upper portion of the respective clip;

said upper portion of each clip having at an end opposite said lower portion of the respective clip;

said end of said upper portion of said fixed clip being coupled to said outer side of said upper ring;

said end of said upper portion of said sliding clip being slidably mounted to said upper ring to permit slidable positioning of said sliding clip along an arc defined along said outer side of said upper ring;

said top end of said support being interposed between said ends of said fixed and sliding clips;

said upper portions of said clips being extending radially outwards from said outer side of said upper ring such that said lower portions of said clips are spaced apart from said upper ring;

said upper portions of said clips generally lying in a common plane with said upper edge of said upper ring;

wherein said upper ring having an elongate slot therethrough between said inner and outer sides of said ring and extending in an arc along said upper ring;

said arc of said slot lying in a plane substantially parallel to said planes of said upper and lower edges of said upper ring;

said slot having a terminus positioned adjacent said top end of said support such that said top end of said support is interposed between said terminus and said end of said upper portion of said fixed clip;

said end of said upper portion of said sliding clip having a downwardly extending tab, said tab having an extent outwardly extending therefrom through said slot of said upper ring to permit sliding of said extent along said arc of said slot;

said extent terminating at a stop flange located adjacent said inner side of said upper ring such that said slot of said upper ring is interposed between said stop flange and said tab;

said stop flange and said slot each having a width defined in a direction extending between said upper and lower edges of said upper ring, said width of said stop flange being greater than said width of said slot;

at least two seats each having a backrest and being arranged in a row such that said backrest generally lying a common vertical plane; and said fixed clip being hooked over said back rest of a first of said seats, said sliding clip being hooked over said backrest of a second of said seats positioned adjacent said first seat such that said upper ring and said base are positioned adjacent a space between said backrests of the adjacent first and second seats.

* * * * *